US009260770B2

(12) United States Patent
Jönsson et al.

(10) Patent No.: US 9,260,770 B2
(45) Date of Patent: Feb. 16, 2016

(54) AUSTENITIC FE-CR-NI ALLOY FOR HIGH TEMPERATURE USE

(75) Inventors: Bo Jönsson, Västerås (SE); Thomas Helander, Västerås (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 12/928,486

(22) Filed: Dec. 13, 2010

(65) Prior Publication Data

US 2011/0147368 A1 Jun. 23, 2011

Related U.S. Application Data

(62) Division of application No. 10/574,203, filed as application No. PCT/SE2004/001288 on Sep. 8, 2004, now abandoned.

(30) Foreign Application Priority Data

Nov. 2, 2003 (SE) ..... 0302611

(51) Int. Cl.

| | |
|---|---|
| ***C22C 30/00*** | (2006.01) |
| ***C22C 19/05*** | (2006.01) |
| ***C22C 38/02*** | (2006.01) |
| ***C22C 38/40*** | (2006.01) |

(52) U.S. Cl.

CPC ..... *C22C 30/00* (2013.01); *C22C 19/055* (2013.01); *C22C 38/02* (2013.01); *C22C 38/40* (2013.01)

(58) Field of Classification Search

CPC ..... C22C 38/00; C22C 30/00
USPC ..... 148/327; 420/584.1
See application file for complete search history.

(56) References Cited

U.S. PATENT DOCUMENTS

| | | | | |
|---|---|---|---|---|
| 4,077,801 | A | 3/1978 | Heyer et al. | |
| 4,997,623 | A | 3/1991 | Brill | |
| 5,378,427 | A * | 1/1995 | Otsuka et al. | 420/586.1 |
| 5,603,891 | A | 2/1997 | Brill | |
| 5,753,177 | A | 5/1998 | Morinaga et al. | |
| 6,409,847 | B2 | 6/2002 | Kleemann | |
| 6,623,869 | B1 | 9/2003 | Nishiyama et al. | |
| 7,118,636 | B2 * | 10/2006 | Chen et al. | 148/427 |

FOREIGN PATENT DOCUMENTS

| | | |
|---|---|---|
| DE | 196 29 977 | 1/1998 |
| EP | 0 386 730 | 9/1990 |

(Continued)

OTHER PUBLICATIONS

NPL: machine translation of JP 06264193 A, Sep. 1994.*

(Continued)

*Primary Examiner* — Jie Yang
(74) *Attorney, Agent, or Firm* — Morgan, Lewis & Bockius LLP

(57) ABSTRACT

An austenitic alloy for high temperature use, particularly for use in resistance heating elements. The alloy includes primarily the elements Fe, Ni, and Cr, and it has the following main composition, given in weight %, Ni 38-48, Cr 18-24, Si 1.0-1.9, C<0.1, and the balance Fe. The alloy provides good hot form stability, good oxidation resistance, and a relatively high electrical resistance coupled with a low change in resistance as a function of temperature.

6 Claims, 4 Drawing Sheets

(56) References Cited

FOREIGN PATENT DOCUMENTS

| | | | | |
|---|---|---|---|---|
| EP | 0 531 775 | | | 3/1993 |
| EP | 0851037 | | | 7/1998 |
| JP | 57085958 | A | | 5/1982 |
| JP | 61-179833 | | | 8/1986 |
| JP | 63-278690 | | | 11/1988 |
| JP | 3-229838 | | | 10/1991 |
| JP | 4-350149 | | | 12/1992 |
| JP | 5-70895 | | | 3/1993 |
| JP | 06264193 | A | * | 9/1994 |
| JP | 09-272956 | | | 10/1997 |

OTHER PUBLICATIONS

NPL: English translation of JP57085958A, May 1982.*

NPL: on-line English translation of JP 04350149 A, Dec. 1992.*

Communication under Rule 71(3) EPC, dated Mar. 23, 2012, stating intent to grant a patent with 2 claims for EP Application No. 04 775 393.4-2122.

Claims sheet of allowed claims in EP Application No. 04 775 393.4-2122, bearing printed date of Jan. 3, 2012.

Decision to grant a European patent pursuant to Article 97(1) EPC, for EP Application No. 04 775 393.4-2122, dated Jul. 12, 2012.

Extract from the Register of European Patents, dated Jul. 10, 2012, for European Patent No. EP 1 680 523, based upon EP Application No. 04 775 393.4-2122, to be published on Aug. 8, 2012.

Office Action for Swedish Patent Application No. 0302611-9, dated Apr. 28, 2004.

International Search Report for International Application No. PCT/SE2004/001288, dated Dec. 27, 2004.

Written Opinion of the International Search Report for International Application No. PCT/SE2004/001288, dated Dec. 27, 2004.

Office Action for Chinese Patent Application 2004800286249, dated Jul. 20, 2007.

English Translation of Office Action for Japanese Patent Application No. 2006-532219, dated May 7, 2010.

Office Action for European Patent Application 04 775 393.4, dated Dec. 30, 2010.

Office Action for European Patent Application 04 775 393.4, dated Jun. 22, 2011.

Office Action for European Patent Application 04 775 393.4, dated Dec. 1, 2011.

Office Action for European Application No. 11190128.6 dated Apr. 23, 2014.

Office Action European Application No. 11190128.6 dated Feb. 23, 2015.

European Search Report for European Application No. 11190128.6 dated Jan. 27, 2014.

* cited by examiner

AUSTENITIC FE-CR-NI ALLOY FOR HIGH TEMPERATURE USE

CROSS-REFERENCE TO RELATED APPLICATIONS

This application is a division of copending U.S. application Ser. No. 10/574,203, filed on Oct. 30, 2006, which is the U.S. national phase application based upon International Application No. PCT/SE2004/001288, having an international filing date of Sep. 8, 2004, and designating the United States, the entire contents of each of which applications is hereby incorporated by reference to the same extent as if fully rewritten.

BACKGROUND OF THE INVENTION

1. Field of the Invention

The present invention relates to an austenitic Fe—Cr—Ni alloy for use at high temperatures.

2. Description of the Related Art

Austenitic Ni-base alloys containing Cr up to 30 wt %, Si up to 3 wt %, varying amounts of Fe and sometimes additions of R.E.-elements (Rare Earth) have long been used for a variety of high temperature parts up to 1100° C. service temperature. Regarding electric resistance alloys used for heating in industrial furnaces and in appliances, several alloys with varying amount of Ni are standardized in ASTM B 344-83 and in DIN 17470. These standards are not fully compatible as seen from Table 1. There are several commercial resistance alloys using variations on the theme, such as the 37-21 alloy, comprising 37% Ni, 20 to 21% Cr, 2% Si, and the balance Fe, and minor additions of rare earth elements including Yttrium (designated R.E.).

It is an object of the present invention to provide alloy compositions that combine the lower cost of a Ni content in the range, if possible, close to NiCr 30/20, i.e., 30 wt % Ni and 20 wt % Cr, with i) a good hot form stability; and ii) an oxidation resistance; and iii) a relatively high electrical resistance and low change of resistance (Ct); of a higher Ni content alloy such as NiCr 60/15.

TABLE 1

Summary of ASTM and DIN Standards for resistance eCr(Fe) alloys

DIN *) 1774
- W. .Cr Ni+C Fe Al Si Mn C Oth Note p Ct
Nr. o er (pQm) 900° C . NiCr 2.4 19- >75 <1,0 <0, 0,5- <1, <0,
R.E 1,12( 1, 14 80 869 21 3 2,0 0 15 .1,08) 20
NiCr 2.4 ...30 >60 <5,0 <0, 0,5- <1, <0, R.E 1,19( 1,27 )
- 70 658. .3 2,0 0 10 .1,16) 30 .~
NiCr 2.4 14- >59 19,0 <0, 0,5- >2, <0, R.E 1,13( 1,23 -)
60 867 19 -3 2,0 0 15 .1,11) 15 ...25,0 .
NiCr 1.4 20,028.,0 ba1 2,00 <1, <0, Only 1,04 1,28 30 860..-
--5 20 17470 20 22,031,0 3,00
NiCr 1.422,0 19,0 bal 1,5- <2, <0, Only 0,95 1,24 25 843
--2,5 00 20 17470 20 25,022,0
ASTM B 344-83
80Ni 19- bal. <1,0 0,75 <2, <0, S<O,O 1,081 " , 21 -5 15 1 :) 20Cr 1,75
60Ni 14- >57 0,75 <1, <0, S<O,O 1,122 , 18 -0 15 1
16Cr 1,75 .. 35Ni 18- 34- bal 1,0- <1, <0, R.E S<O,O 1,014
. , 21 37 3,0 0 15 .1 20Cr
* Maximum 1% Co In general, the maximum operating temperature and lifetime of an alloy increases with increased Ni-content, but several other elements have great impact on these properties as well. All of these alloys form a protective oxide layer composed of mainly $Cr_2O_3$, and in case of Si additions also $SiO_2$ to some extent. Smaller additions like rare earth elements have been used to further enhance the properties of the oxide layer, and several patents advise additions to provide a material with good oxidation life, see, e.g., EP 0 531 775 and EP 0 386 730.

In addition to good oxidation there is also a demand for good hot strength. In case of electric elements, the cost for hangers and support systems can be reduced if the material is strong enough to support its own weight, and therefore to maintain its shape at operating temperature.

For use as electric elements, the relatively high resistivity and low $Ct=R_{hot}/R_{cold}$ ratio of resistance change from room temperature to working temperature is an important parameter. In general, the higher the Ni, the higher the resistivity and the lower the Ct factor.

Addition of elements such as Mo and W up to levels of several wt % are known to enhance the mechanical properties at high temperatures, but they are expensive and are therefore not desirable additions in applications where cost is important.

In a wide range of open coil electric resistance heating elements, NiCr 60/15 and NiCr 30/20 type (DIN) or 60 Ni, 16 Cr and 35 Ni, 20 Cr (ASTM) alloys are used. From a cost point of view, the NiCr 30/20 or 35Ni, 20Cr type is preferred due to their lower content of expensive Ni. In applications where the watt density and therefore the element temperature are high, the oxidation life of alloys with this level of Ni has up to now been insufficient. At the same time, the mechanical properties at working temperatures have to be within acceptable limits.

SUMMARY OF THE INVENTION

The present invention relates to an alloy for high temperature use. The alloy mainly comprises Fe, Ni, and Cr and has the following main composition, given in weight %, Ni 38-48,
Cr 18-24,
Si 1.0-1.9,
C<0.1, and in that Fe is the balance.

DESCRIPTION OF THE PREFERRED EMBODIMENTS

It is important that the content of C is below 0.1 wt %.

Eight test melts were cast, hot rolled, and cold drawn to wire according to standard practice with chemical composition according to Table 2.

TABLE 2

Chemical composition of test melts

| Melt # | 1 | 2 | 3 | 4 | 5 | 6 | 7 | 8 |
|---|---|---|---|---|---|---|---|---|
| Ni | 45.5 | 44.2 | 44.3 | 44.8 | 35.0 | 35.0 | 35.3 | 35.2 |
| Cr | 25.4 | 25.3 | 14.9 | 15.0 | 26.5 | 24.8 | 15.0 | 15.0 |
| Si | 2.64 | 1.10 | 3.69 | 1.18 | 2.72 | 1.16 | 3.06 | 1.13 |
| Al | 0.08 | 0.13 | 0.14 | 0.16 | 0.12 | 0.13 | 0.14 | 0.13 |
| N | 0.04 | 0.05 | 0.02 | 0.02 | 0.04 | 0.04 | 0.04 | 0.02 |
| C | 0.07 | 0.06 | 0.09 | 0.07 | 0.08 | 0.10 | 0.10 | 0.08 |
| S | 0.001 | 0.002 | 0.001 | 0.002 | 0.003 | 0.002 | 0.002 | 0.002 |
| P | 0.007 | 0.008 | 0.006 | 0.006 | 0.008 | 0.009 | 0.006 | 0.006 |
| Other | <1 | <1 | <1 | <1 | <1 | <1 | <1 | <1 |
| Fe | Bal. | Bal. | Bal. | Bal. | Bal. | Bal. | Bal. | Bal. |

Figure 1:
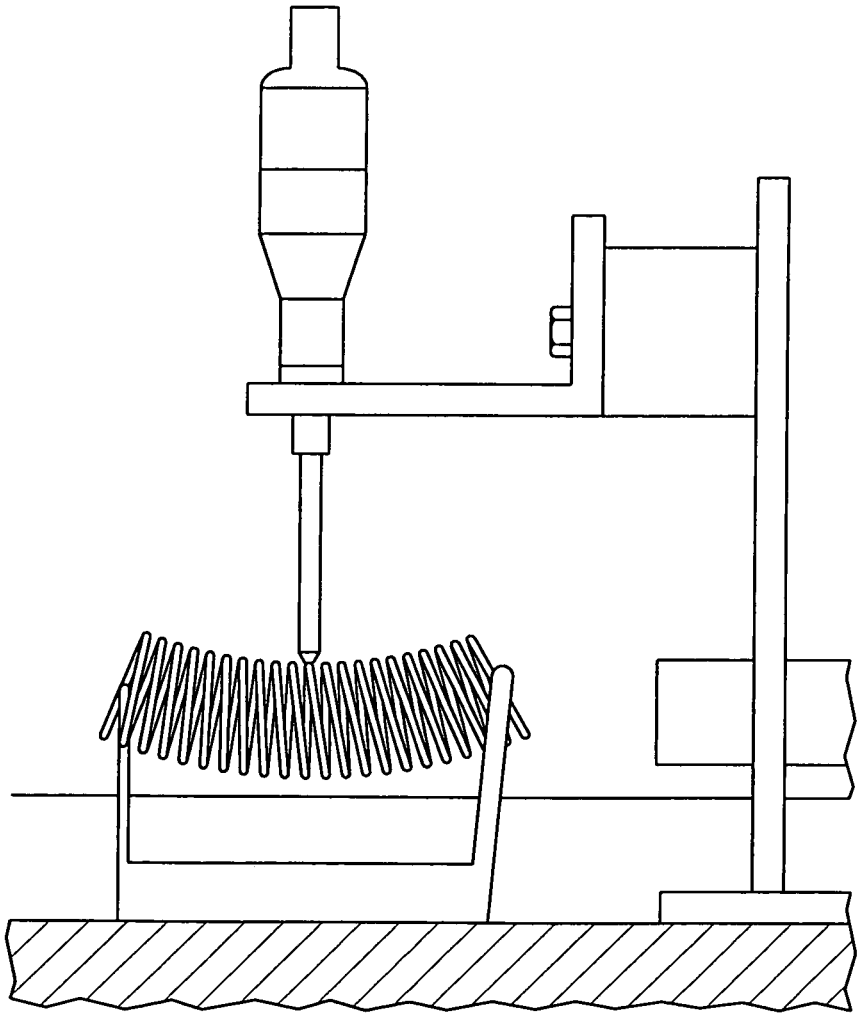
FIG. 1 shows a test setup for measuring deformation of a heating coil.

The wires were coiled into helixes and mounted on sample holders. These were exposed to a high temperature, 950° C., by means of a laboratory furnace for 168 hours. Deformation of the helixes was measured by means of a micrometer screw according to the setup in FIG. 1.

Since these products are working at a high temperature, the oxidation life and in particular the cyclic oxidation life is an important design factor. In order to evaluate this property a cyclic oxidation test was performed. The sample wires were heated by passing electric current through them and the wires were exposed to a 2 minutes on/2 minutes off cycle. The time to burn off was recorded and the results were grouped according to performance.

A combination of the deformation performance that occurs from relatively small applied forces, such as gravity acting on, e.g., suspended heater coils, and oxidation performance at high temperature, is therefore an object of the present invention.

The results indicate that not only the level of each element, but in addition the relative contents of the base elements Nickel, Chromium, and Silicon, have a surprisingly large impact on performance.

TABLE 3

Results from deformation and oxidation tests. "+' designates a better than average result.

| Melt # | 1 | 2 | 3 | 4 | 5 | 6 | 7 | 8 |
|---|---|---|---|---|---|---|---|---|
| Sag | | + | | + | | + | | + |
| Life | + | + | | | + | + | | |

It has now been found that the relation between these elements has to be within a narrow range that is given on the one hand by sufficient deformation performance and on the other hand by adequate oxidation performance. Only in this narrow band of compositions was the optimum compromise achieved that gave the working solution.

An alloy in accordance with the invention has the main composition (in wt %) of Ni ranging from 38 to 48. The Cr level is larger than $$Cr=-0.1Ni+24$$

and is smaller than $$Cr=-0.1667Ni+30.$$

At the same time, the Si level is larger than $$Si=1.0$$

and is smaller than $$Si=-0.01Ni+1.9.$$

Figure 2:
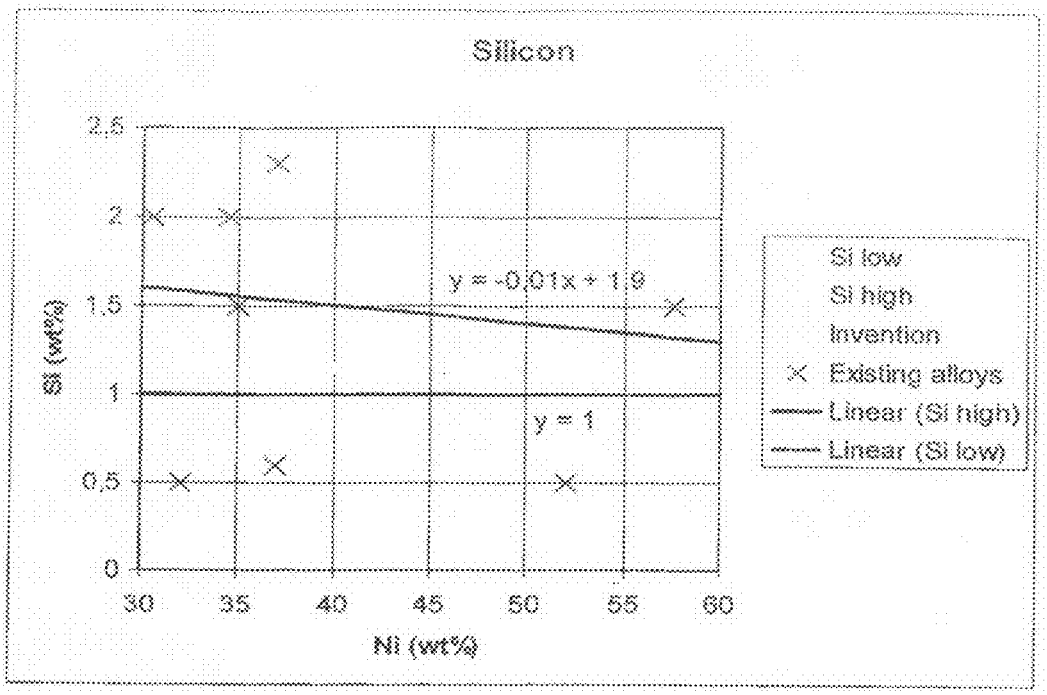
FIG. 2 is a graph showing linear relationships between Si content and Ni content for an alloy in accordance with the invention and in comparison with existing alloys.
Figure 3:
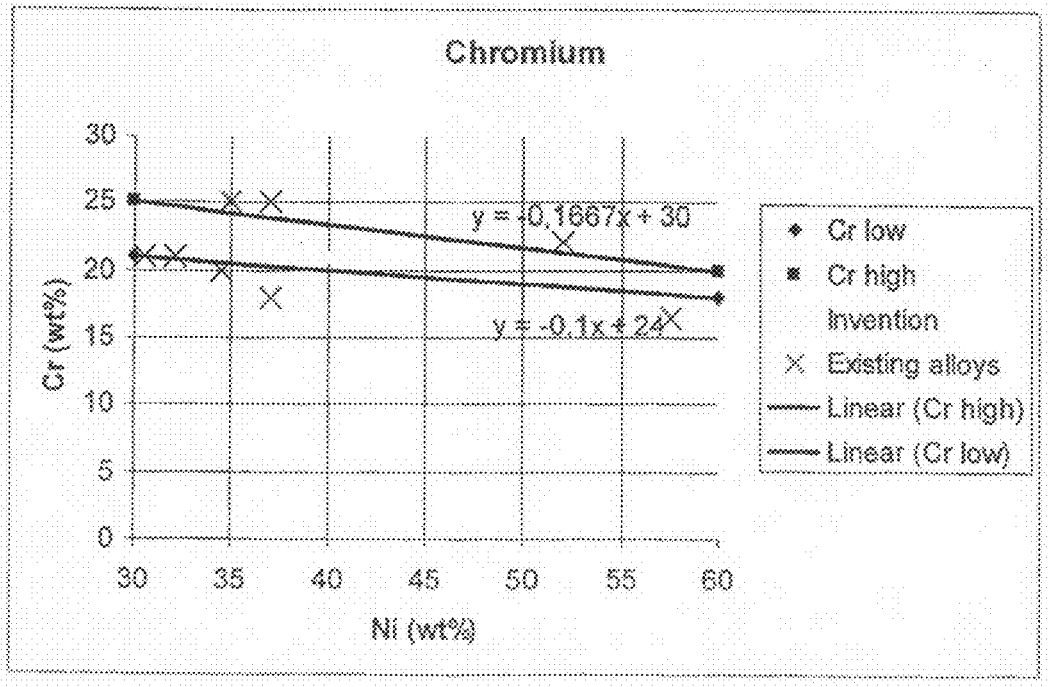
FIG. 3 is a graph showing linear relationships between Cr content and Ni content for an alloy in accordance with the invention and in comparison with existing alloys.

In FIGS. 2 and 3 the above-mentioned Si content and Cr content are shown by means of graphs, where alloys in accordance with the invention are compared with existing alloys.

The alloy can also contain up to 5% Co as a substitute for Ni and Mn up to 2%. Further, it contains Al up to 0.6%, and preferably above 0.03%, and R.E., Y, and Ca up to a level of 0.2% in total. C should be <0.1 and N in a range up to 0.15%, preferably above 0.03%. Nitride and carbide formers such as Ti, Zr, Hf Ta, Nb, and V can be added up to a total level of 0.4% but are not necessary to benefit from the advantages of the invention. The remainder consists of iron and various elements originating from the raw materials and the production process, up to a total level of <2%.

A specific example of an alloy according to the invention contains (in wt %)

Ni 39-41,
Cr 20-22,
Si 1-1.5,
N 0.15,
Ce 0.01-0.04,
C<0.1,
impurities up to 2%, and
Fe the balance.

Another example of an alloy in accordance with the invention having further improved oxidation performance due to the higher Ni content, but with otherwise comparable properties, is Ni 44-46,
Cr 20-22,
Si 1-1.5,
N<0.15,
Ce 0.01-0.04,
C<0.1,
impurities up to 2%, and
Fe the balance.

Figure 4:
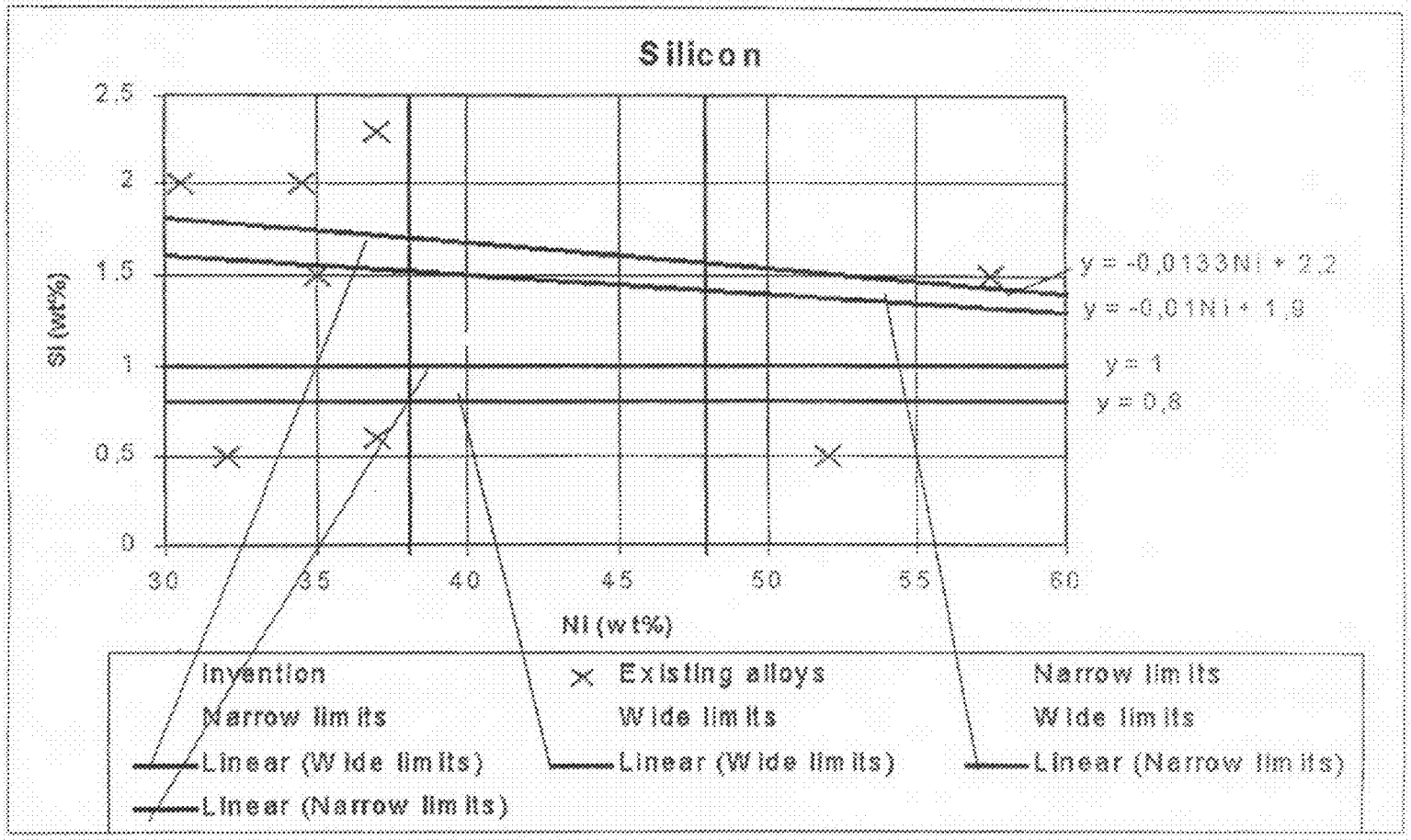
FIG. 4 is a graph showing additional linear relationships between Si content and Ni content for an alloy in accordance with the invention and in comparison with existing alloys.
Figure 5:
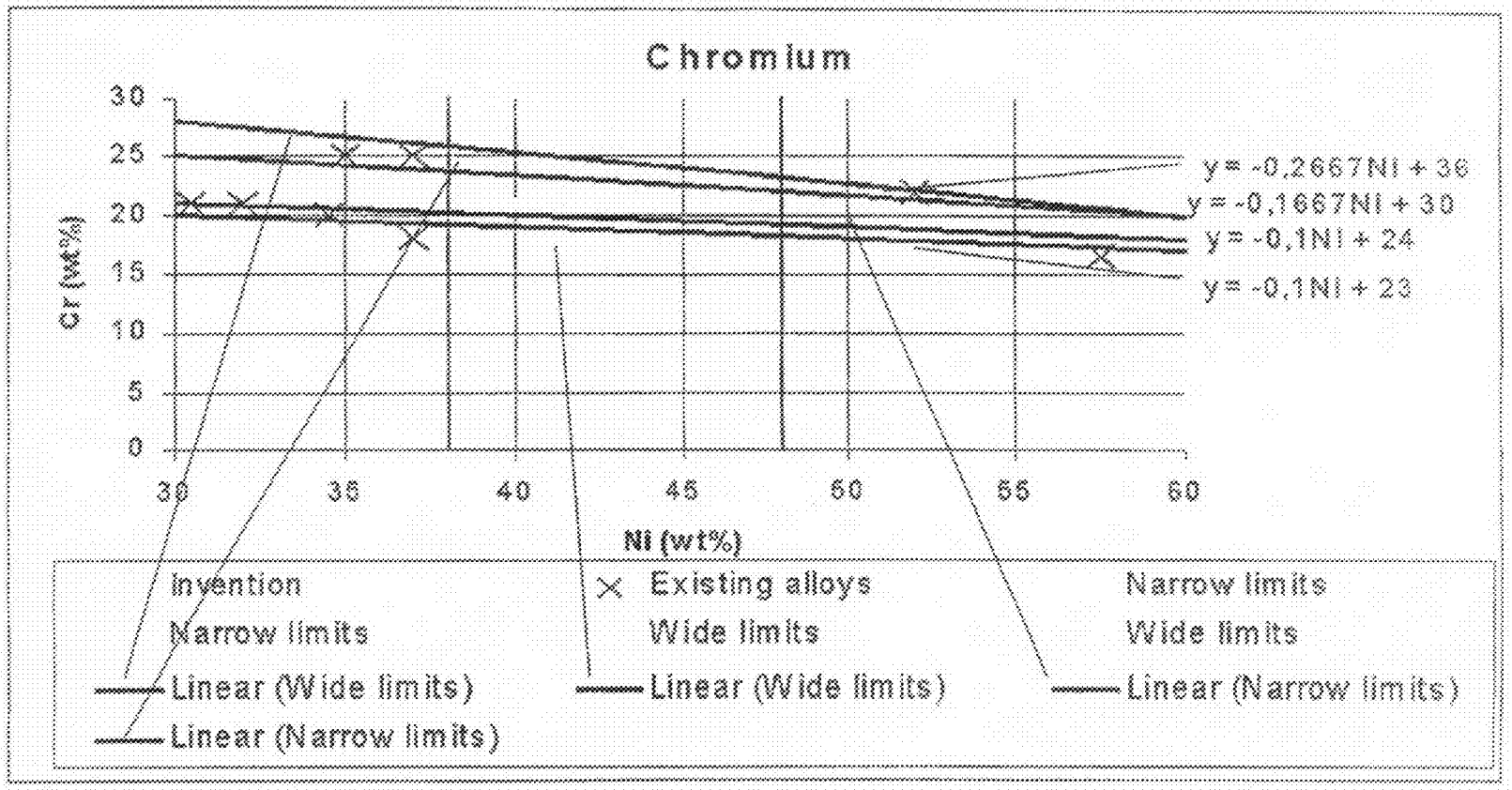
FIG. 5 is a graph showing additional linear relationships between Cr content and Ni content for an alloy in accordance with the invention and in comparison with existing alloys.

Preferred embodiments are as follows, with the composition in weight %. In FIGS. 4 and 5 the below-mentioned Si content and Cr content are shown by means of graphs, where alloys in accordance with the invention are compared with existing alloys.

An alloy comprising
Ni 38-48,
Cr between −0.1Ni+23 and −0.2667Ni+36,
Si between 0.8 and −0.0133 Ni+2.2, and
Fe the balance.

An alloy comprising
Ni 40,
Cr 21,
Si 1.2,
N<0.15,
Ce 0.03,

C<0.1,
impurities up to 2%, and
Fe the balance.
An alloy comprising
Ni 45,
Cr 21,
Si 1.2,
N<0.15,
Ce 0.03,
C<0.1,
impurities up to 2%, and
Fe the balance.
Another alloy that is preferred comprises
Ni 38-48,
Cr larger than Cr=−0.1Ni+24 and smaller than Cr=−0.1667Ni+30,
Si larger than Si=1.0 and smaller than Si=−0.01 Ni+1.9, C<0.1,
Al up to 0.6, and
Fe the balance.
The alloy can also contain up to 5% Co as substitute of Ni
Mn up to 2,
Al up to 0.3,
R.E., Y and Ca up to a level of 0.2% in total,
C<0.1,
N<0.15,
Ti, Zr, Hf, Ta, Nb, and V up to a total level of 0.4,
<50 wt ppm S,
various elements originating from the raw materials and the production process up to a total level of <2, and
Fe the balance.
An alternative is:
38-48 Ni,
18-22 Cr,
1.0-1.5 Si,
Al<0.6,
<0.15,
N<0.15,
<1 Mn,
<50 wt ppm S,
<0.5 in total sum of elements belonging to the group Ti, Zr, Hf, Y, Rare Earth Elements (Lantanoid group), Ca, Mg, Ta,
<5 totally of elements belonging to the group Mo, Co, Ta, W,
<0.4 totally of elements belonging to the group Ti, Zr, Hf, Ta, Nb, and V,
<1 of other elements arising from impurities in the melting process, and Fe the balance.
Further preferred embodiments are an alloy comprising,
Ni 39-41,
Cr 20-22,
Si 1-1.5,
Mn 0.5
C 0.02,
N<0.15,
Ce 0.01-0.04,
impurities up to 2%,
and in that Fe is the balance.
And an alloy comprising,
Ni 44-46,
Cr 20-22,
Si 1-1.5,
Mn 0.5,
C 0.02,
N<0.15,
Ce 0.01-0.04,
impurities up to 2%,
and in that Fe is the balance.

Table 4 below is a comparison of commercially available alloys with alloys in accordance with the invention.

| Alloys | Ni | Cr | Si | Other |
|---|---|---|---|---|
| 353MA | 35 | 25 | 1.5 | N 0.17 |
| Incoloy DS | 37 | 18 | 2.3 | |
| Incoloy 800 | 32 | 21 | 0.5 | |
| Incoloy 617 | 52 | 22 | 0.5 | Al 1.2 |
| Haynes HR-120 | 37 | 25 | 0.6 | Nb 0.7 |
| Nikrothal 80 | 80 | 20 | 1.35 | |
| Nikrothal 60 | 57.5 | 16 | 1.5 | |
| Nikrothal 40 | 37 | 20 | 2 | |
| Nikrothal 30 | 30 | 21 | 2 | |
| Nikrothal 20 | 21 | 25 | 2.3 | |
| Invention ex 1 | 40 | 21 | 1.3 | |
| Invention ex 2 | 45 | 21 | 1.2 | |

The alloy 353MA is produced by Outokumpo Oyj, Espoo, Finland. The alloy Incoloy is produced by Special Metals Corp., Huntington, W. Va., USA. The Haynes alloy is produced by Haynes International, Inc., Kokomo, Ind., USA. Nikrothal is produced by the assignee.

As is apparent from the above, the present invention fulfills the objects mentioned in the opening part of the present application.

What is claimed is:

1. An electric resistance heating element having excellent oxidation resistance properties at temperatures up to 950° C., consisting of the following elements by weight %:
Ni 39-41,
Cr between −0.1Ni+24 and −0.1667Ni+30,
C<0.1,
Si 1.0-1.5,
Al 0.03-0.6,
N<0.15,
Mn<1,
S<50 wt ppm,
elements selected from the group consisting of Ti, Zr, Hf, Y, rare earth elements lantanoid group, Ca, Mg, and Ta at less than 0.5 total,
Co less than 5, and
elements selected from the group consisting of Nb and V at less than 0.4 total,
unavoidable impurities, and
the balance is Fe.

2. An electric resistance heating element in accordance with claim 1, wherein the rare earth elements lantanoid group is Ce, and Ce is present in an amount by weight % of 0.01 to 0.04.

3. An electric resistance heating element in accordance with claim 1, wherein the following elements are present, by weight %:
Cr 20-22, and
Ce 0.01-0.04.

4. An electric resistance heating element in accordance with claim 1, wherein the following elements are present, by weight %:
Cr 20-22,
C 0.02, and
Ce 0.01-0.04.

5. An electric resistance heating element in accordance with claim 1, wherein the electric resistance heating element is an open coil heating element.

6. An electric resistance heating element in accordance with claim 1, wherein the following elements are present, by weight %: Mn about 0.5.

* * * * *